United States Patent [19]

Shoemaker et al.

[11] 4,018,396

[45] Apr. 19, 1977

[54] EMBEDDED HOUSING FOR ORE CRUSHER

[75] Inventors: Robert S. Shoemaker, Millbrae; Donald H. Moyer, El Cerrito; Joseph J. Newman, Orinda, all of Calif.

[73] Assignee: Bechtel International Corporation, San Francisco, Calif.

[22] Filed: May 5, 1975

[21] Appl. No.: 574,217

[52] U.S. Cl. ..... 241/301; 52/169.6; 52/236.2; 52/245; 241/285 R

[51] Int. Cl.[2] ..... B02C 23/00

[58] Field of Search ..... 241/285 R, 301; 52/20, 52/169, 194, 237, 245

[56] References Cited

UNITED STATES PATENTS

| | | | |
|---|---|---|---|
| 1,307,432 | 6/1919 | Aten | 52/20 |
| 2,917,138 | 12/1959 | Walsh | 52/245 |
| 3,289,366 | 12/1966 | Abrams | 52/194 X |
| 3,382,633 | 5/1968 | Wilson et al. | 52/237 |

*Primary Examiner*—Roy Lake
*Assistant Examiner*—Howard N. Goldberg
*Attorney, Agent, or Firm*—Townsend and Townsend

[57] ABSTRACT

An improved housing embedded in the ground for use in crushing of ore. The housing has a generally figure eight configuration in plan defined by a pair of hollow, upright cylindrical segments with a common wall between the points of intersection of the segments. One segment houses a dump pocket, an ore crusher, a surge chamber and a discharge feeder and conveyor in descending order, and the other segment contains drive machinery, dust control apparatus, a lubrication system, hoist ways, elevator shaft, and other service facilities. The crusher in the first segment is supported on a floor supported by the wall of the first segment itself. The housing requires only a minimum of concrete and reinforcing steel since the cylindrical configuration of the sections thereof provide the most efficient resistance to lateral pressures resulting from earth backfill and surcharge from heavy haul trucks.

17 Claims, 6 Drawing Figures

EMBEDDED HOUSING FOR ORE CRUSHER

This invention relates to improvements in the embedded housing of ore crushers and associated equipment and, more particularly, to an embedded crusher housing which requires only a minimum of concrete and reinforcing steel and which utilizes the interior space thereof more efficiently than is capable with conventional housing structures.

BACKGROUND OF THE INVENTION

It is well-known to provide an ore crusher in a rectangular, box-shaped embedded housing of reinforced concrete. This permits heavy haul ore trucks to dump their contents into a hole in the ground to eliminate the need for elevating the uncrushed ore to a height which would require considerable work to do so. the rectangular configuration of such a housing requires that a considerable amount of concrete and reinforcing steel be used to render the housing structurally sound but yet large enough to house not only the crusher itself but also other equipment and chambers, such as an elevator, a surge pocket, a conveyor, drive machinery and the like. Moreover, in the construction of a rectangular housing of conventional design, considerable expense is always encountered in the placement of the large amount of reinforcing steel that is required. Also, a problem exists in properly pouring concrete around the closely spaced reinforcing steel to form the rectangular wall of the housing.

An attempt to reduce the amount of concrete and reinforcing steel in housing of this type has resulted in the development of a housing having a single circular shape, such as a standard silo shape. This shape, when considered from a structural point of view, offers great promise because the exterior wall of concrete is stressed in its most efficient manner, i.e., as a closed ring in compression. Such a structure has an ability to resist the very high lateral pressures resulting from earth backfill as well as the surcharge from heavy haul trucks. The single circle configuration offers a significant savings in materials when compared with the heavy slab-beam-strut concept used in the conventional rectangular crusher housing and the massive use of concrete and reinforcing steel of such rectangular housing. These savings result from a reduction of average exterior wall thickness of three to four feet as required by the rectangular structure to a minimum of eighteen to twenty-four inches for the single circular configuration. In addition, significant savings in reinforcing steel are achieved due to the concept of carrying principal loads by concrete in compression instead of bending in heavy slabs.

While the single circular shape of pressure housing has certain advantages, it does not provide for the optimum use of the space therein. This drawback requires that the single circular housing be relatively large in size, thereby requiring large amounts of concrete and reinforcing steel although such amounts are less than those required in the conventional rectangular housings.

Because of the foregoing, a need has arisen for an improved underground crusher housing which utilizes the structural features of the single circular configuration of housing yet further minimizes the concrete and reinforcing steel required to provide a structurally sound housing yet provide for adequate space to contain all of the necessary equipment to carry out ore crushing operation.

SUMMARY OF THE INVENTION

The present invention is directed to an improved housing for the underground mounting of an ore crusher and its associated equipment. To this end, the housing has a generally figure-eight configuration in plan, defined by a pair of intersecting, hollow, upright, generally cylindrical segments with a common wall between the points of intersection of the segments. The intersecting cylinders will be usually but not necessarily circular cylinders. Structural requirements make circular cylinders preferable but the arrangement of machinery within the housing and size limitations may make an eliptical cylinder preferable for one or both segments. One of the segments is adapted to contain the dump pocket, the ore crusher, the surge pocket, and a lateral discharge feeder; whereas, the other segment is adapted to contain equipment such as an elevator and elevator shaft, an inclined conveyor leading off through an inclined tube communicating with the lower end of the other section, dust control apparatus, lubrication system, and other service facilities. The intersecting cylindrical configurations of the segments with the common wall allow the housing, which is formed of reinforced concrete, to provide the most efficient resistance to the high lateral pressures resulting from earth backfill and the surcharge from heavy haul ore trucks, while allowing for the optimum of the space in the housing, thereby keeping the size of the housing relatively small to minimize the volume of concrete and the amount of reinforcing steel which must be used to form the housing.

Another aspect of the housing of this invention is the way in which the ore crusher and other equipment and feed ore and crushed ore are supported in the segments. The segment of the housing containing the crusher is provided with a floor or corbel extending inwardly from the inner surface of the segment and supported directly from the segment wall and the common wall and the ore crusher is supported on the floor or corbel and extends through a central opening therein. This feature eliminates the need for columns, beams and the like which have heretofore been used to support the crusher in conventional rectangular and single circular ore crushing housings. Other floors and corbels similarly supported directly from the housing walls provide support for the other equipment, the feed ore and the crushed ore without the use of columns, beams and the like.

The present invention, therefore, meets needs caused by deficiencies of prior art ore crusher housing and assures that a stable, structurally sound construction can be achieved with a minimum of concrete and reinforcing steel while providing optimum usage of the space within the two sections of the housing. Significant savings in material costs can, therefore, be realized, yet all of the operating advantages of prior art housings can be provided in the housing of the present invention.

The primary object of this invention is to provide an improved embedded housing for an ore crusher, wherein the housing can be constructed with significantly less concrete and reinforcing steel than is required in the construction of conventional housings.

Another object of this invention is to provide a housing of the type described wherein the housing has a generally figure-eight configuration in plan defined by a pair of intersecting hollow, upright, cylindrical segments with a common wall between the points of intersection of the segments so that the configuration presents the most efficient manner of stressing the concrete defining the segments so as to resist the relatively high lateral pressures exerted on the housing due to earth backfill and the surcharge from heavy haul ore trucks.

Other objects of this invention will become apparent as the following specification progresses, reference being had to the accompanying drawings for an illustration of the invention.

Figure 1:
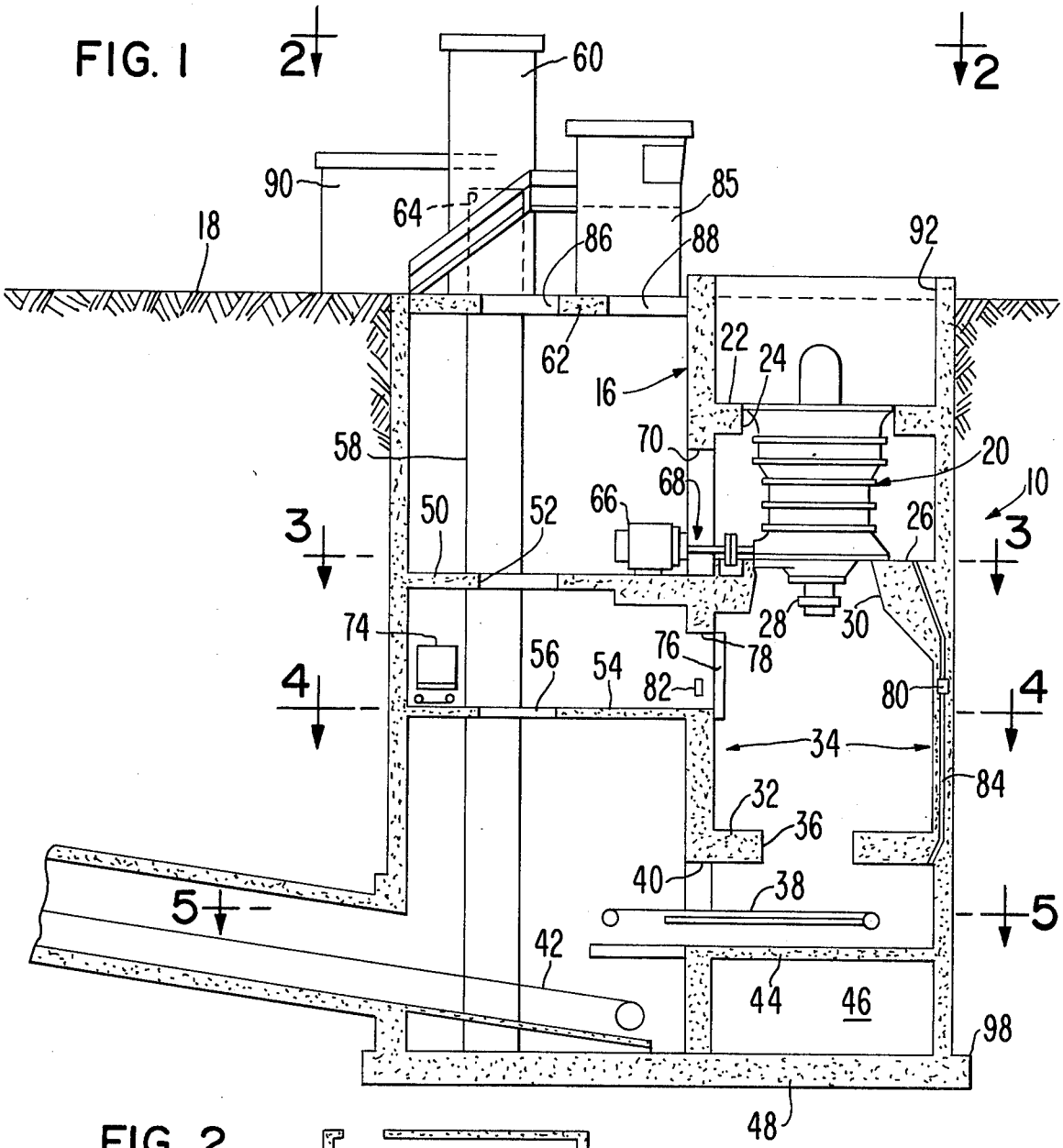
FIG. 1 is a vertical section through the underground housing for an ore crusher forming the subject of the present invention.
Figure 2:
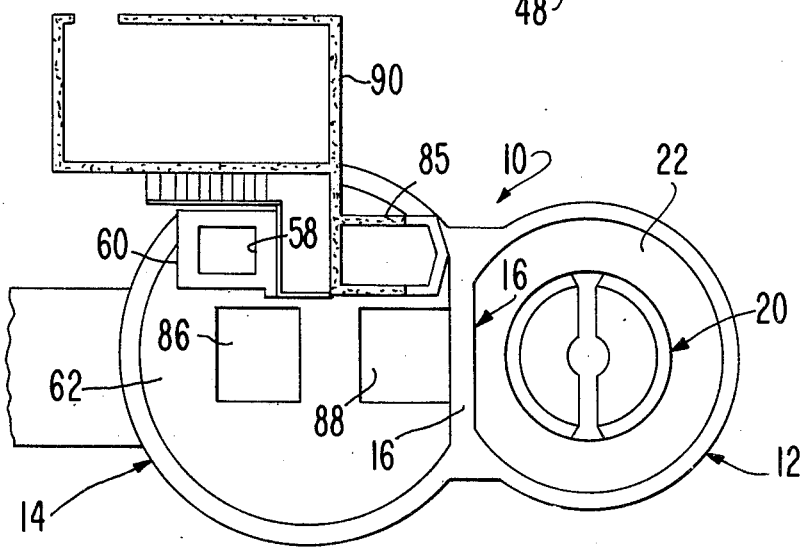
FIG. 2 is a top plan view of the housing looking in the direction of line 2—2 of FIG. 1.
Figure 3:
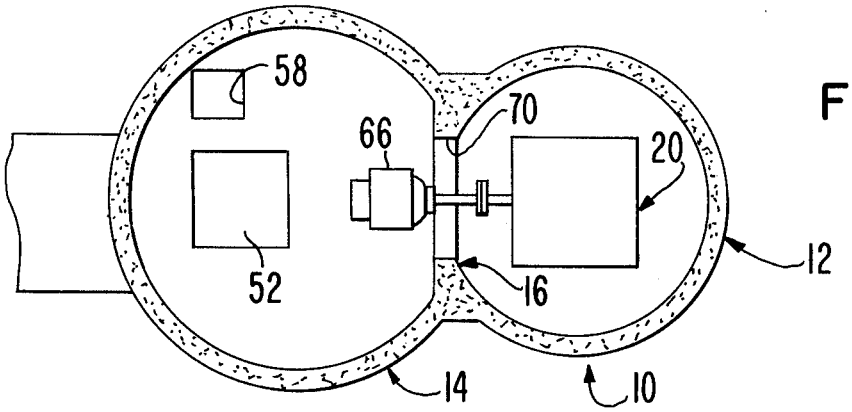
Figure 4:
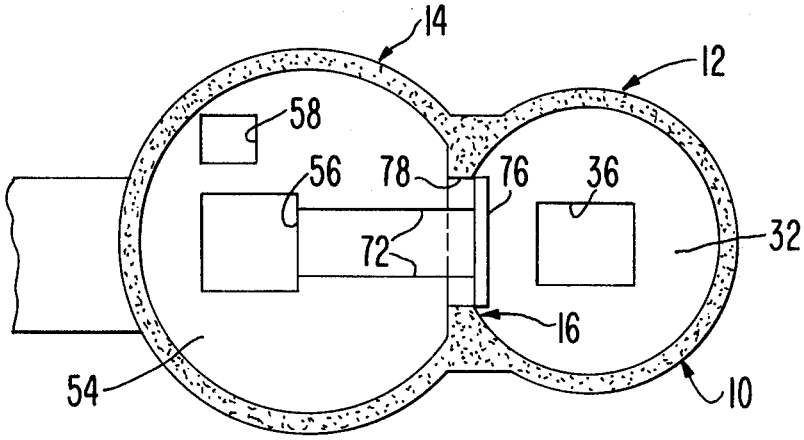
Figure 5:
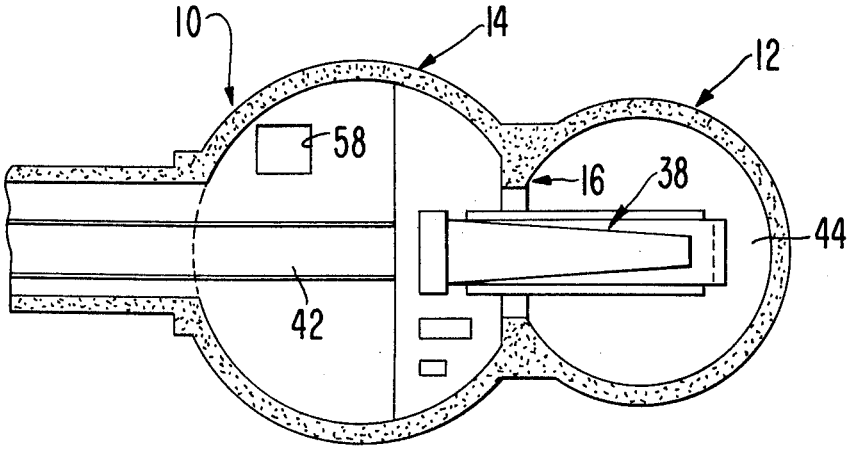
Figure 3A:
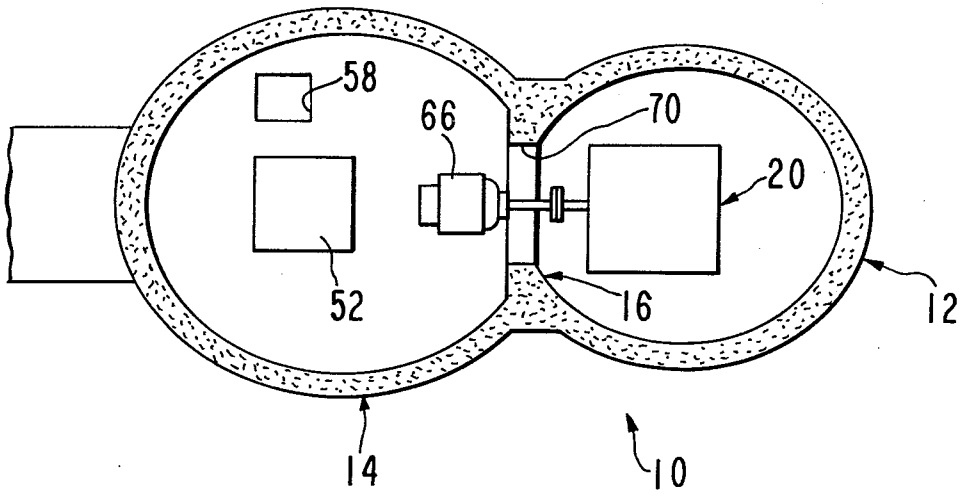

FIGS. 3, 4 and 5 are horizontal sections taken through lines 3—3, 4—4 and 5—5, respectively, of FIG. 1; and FIG. 3*a* is a view similar to FIG. 3 but showing elliptical housing segments.

The underground housing of the present invention is broadly denoted by the numeral 10 and has a figure eight configuration in plan form as shown in FIGS. 2–5. The housing is made up of two cylindrical segments 12 and 14 which are interconnected by a common wall 16. The figures show circular cylinders but other cylindrical shapes might be preferable in certain circumstances, such as elliptical cross sections as shown in FIG. 3*a*. Segments 12 and 14 are not completely cylindrical in that wall 16, which lies in a generally vertical plane, forms a closure across the open end segment. Segment 12 has a diameter less than segment 14 and, as shown in FIG. 1, segment 12 is slightly higher in elevation than segment 14, the latter having its upper extremities substantially flush with ground level 18.

An ore crusher 20 of conventional construction is located in segment 12 near the upper end thereof. Crusher 20 is supported laterally by a floor or corbel 22 and extends through an opening 24 in the floor. The crusher is also supported on a second floor or corbel 26 spaced below floor 22. Floors or corbels 22 and 26 are integral with segment 12 and wall 16 and project inwardly therefrom. This construction avoids the need for vertical columns for supporting the crusher as is required in many prior art crusher housings. Crusher 20 also has an ore discharge passage 28 which is a central opening in floor 26.

The area above floor 22 and the top of the crusher receives ore from trucks. When trucks of about 150 tons or larger capacity are used, this area may take a square or rectangular configuration to prevent trucks from dumping directly on the crusher upper bearing support.

Segment 12 has a third floor or corbel 32 spaced below floor 26 so that a surge pocket 34 is defined between discharge passage 28 of crusher 20 and floor 32, there being a central opening 36 in floor 32 to allow crushed ore from surge pocket 34 to gravitate onto a generally horizontal feeder 38 below floor 32 and to pass through an opening 40 in wall 16 for discharge onto an inclined conveyor 42 at the bottom of segment 14 (FIG. 1). A fourth floor 44 is located below conveyor 38 and supports it.

Segment 14 has a first floor 50 across the interior thereof at a location near but slightly below floor 26 of segment 12. Floor 50 has a covered hatch 52 spaced inwardly from the inner surface of segment 14 for entering and removing mechanical and electrical parts.

A second floor 54 is provided in segment 14 below floor 50. This also has a covered hatch 56 generally aligned with hatch 52 thereabove.

Segment 14 is also provided with an elevator shaft 58 which extends the length of the segment and into a silo or housing 60 supported on the roof or uppermost floor 62 of segment 14. Silo 60 has a doorway 64 for entrance to the elevator (not shown) in shaft 58. On each of floors 50 and 54, there is a doorway permitting access to the elevator in the shaft from each of such floors. Also, there is a doorway at the bottom of the shaft permitting access to the vicinity of conveyor 42.

A drive motor 66 is supported on floor 50 and has a drive shaft 68 passing through opening 70 in wall 16 so that the motor can be coupled with crusher 20 to operate the same for crushing ore.

Floor 54 is provided with a pair of spaced rails 72 (FIG. 4) over which a utility vehicle 74 can be driven. Also, portable tracks 76 can be moved into a position across the upper portion of surge pocket 34 so that vehicle 74 can be driven into the surge pocket to allow workmen to do maintenance work on crusher 20 from beneath the latter, An opening 78 is provided in wall 16 to allow vehicle 74 to move through the wall.

The upper level of the crushed ore in surge pocket 34 can be detected by a unit comprised of a radiation source 80 and a radiation detector 82 generally horizontally aligned with each other. Radiation source 80 is adjustably mounted in a pipe 84 embedded in floor 26 and in the wall structure of section 12 as shown in FIG. 1. Pipe 84 extends between floors 26 and 32 and any suitable means can be utilized, such as a flexible line or the like, to adjustably position radiation source 80 in pipe 84. Radiation detector 82 can be manually positioned in opening 78 so that the radiation detector is in alignment with radiation source 80.

In addition to supporting silo 60, roof 62 also supports a housing 85 which forms a control room for operating crusher 20 and conveyors 38 and 42. Roof 62 also has a pair of covered hatches 86 and 88, hatch 86 being vertically aligned with hatches 52 and 56. A housing 90 to one side of segment 14 defines an electrical room housing control panels and other electrical equipment.

In use, a truck or other vehicle containing ore to be crushed moves over surface 18 and dumps the ore into the open top 92 of segment 12. The ore falls through segment 12 and into crusher 20 where it is crushed when motor 66 is operating. The crushed ore falls into surge pocket 34 and then passes through opening 36 in floor 32 for deposit onto feeder 38. The ore on feeder 38 is then moved at controlled rate to the left when viewing FIG. 1 and gravitates eventually onto inclined conveyor 42 and up the conveyor a relatively long distance to ground level 18. Typically, conveyor 42 will extend above ground level 18 to a processing station spaced thereabove.

Typical dimensions of the various components of housing 10 are as follows: the wall thickness of segments 12 and 14 is 24 inches or less; the diameter of segment 12 is 28 feet; the diameter of segment 14 is 36 feet; the distance from ground level 18 to the upper surface of base 48 is 87 feet. Motor 66 is a 500 hp motor. Crusher 20 is a 60 inch × 89 inch crusher. The distance between the center line of segment 12 and the center line of segment 14 is 30 feet. The thickness of floor 22 is 42 inches. The minimum thickness of floor 26 is 60 inches. The thickness of floor 32 is 30 inches and the thickness of base 48 is 48 inches. The thickness of each of floors 50 and 54 is 18 inches. Conveyor 38 is 7 feet wide and 30 feet long. Conveyor 42 is 5 feet wide.

The construction of housing 10 permits the use of a minimum volume of concrete and a minimum amount of reinforcing steel because the cylindrical cross sections of segments 12 and 14 permit housing 10 to be stressed in its most efficient manner, i.e., as closed ring segments in compression or as closed elliptical cylindrical segments in compression with moderate bending. This assures that housing 10, even when it has a height of 80 feet to 100 feet, has the ability to resist the very high lateral pressures exerted thereon from earth backfill as well as the surcharge from heavy haul trucks. Also, the configuration of housing 10 permits a more efficient utilization of space since it allows the crusher, surge pocket, and discharge conveyor to be in one segment while drive machinery, dust control, lubrication systems, hoistways and elevator can be in another segment. The same principle of utilizing in a circular concrete building the basic strength of concrete in compression is retained by the figure eight configuration of housing 10.

Prior art crusher housings of rectangular and single circular plan forms can be compared in cost with the cost of housing 10 by comparing the amount of concrete and reinforcing steel used in each. The comparison figures are as follows:

| Planform Configuration | Concrete Cubic Yards | Reinforcing Steel, Tons | Reinforced Steel, Avg. Unit Wt. Lbs/Cubic Yards |
|---|---|---|---|
| Rectangular | 3396 | 345.5 | 203 |
| Single Circle | 2285 | 194 | 170 |
| Figure Eight | 1691 | 137 | 162 |

These quantities are for housings in which the same gyratory crusher (60 inch × 89 inch) is installed. The specific requirements of individual users might result in a change in the total amounts of concrete and reinforcing steel required for the rectangular, the circular of figure eight structure. The quantities shown above include reasonable allowances for changes resulting from minor variations in layout.

Based on unit costs as of October 1974 for concrete and reinforcing steel of approximately $130 per cubic yard and approximately $650 per ton in place, respectively, the quantities shown above can be extended on a cost basis as follows:

| Planform Configuration | Concrete | Reinforcing Steel | Total |
|---|---|---|---|
| Rectangular | $441,480 | $224,575 | $666,055 |
| Single Circle | $297,500 | $126,100 | $423,600 |
| Figure Eight | $219,830 | $89,050 | $308,880 |

Considering the method of excavation employed for these underground structures which typically involves the use of heavy earth moving equipment and blasting techniques to create a generous and open site for concrete work, the cost of excavation is considered the same for all three types of structures and, therefore, is excluded from the above comparison.

While several different construction techniques are available and can be used to form housing 10 of the present invention, a preferred technique is the one using slip forms. This technique has the desirable feature of achieving the construction of the basic, external structure of housing 10 in a minimum of time. The technique is also advantageous at construction sites located in colder climates where it is desirable to create a complete exterior enclosure as soon as possible and then to complete the interior features under cover at a time when climatic conditions would severely hamper outside work. Combined with the low unit cost of slipforming the use of permanent metal form-support systems is desirable for constructing the interior floor levels which provides for an expeditious floor pouring schedule to minimize overall costs.

With respect to the question of whether or not the slip form technique is suitable for achieving a solid and substantial finished structure, such as required to support a large piece of moving equipment like a gyratory crusher, it is to be pointed out that features have been developed in housing 10 to satisfy the requirement for such a solid and substantial finished structure. For instance, the thickness of the walls of sections 12 and 14 is preferably about 24 inches. This serves a threefold purpose of providing ample tolerance for the slipform technique, additional mass for supporting the machinery and adequate thickness to provide for substantial keyways used to support horizontal elements. In combination with such keyways, grouting techniques can be used to insure that a positive bond between walls and floors is achieved.

In regions having a high water table, the problem of buoyancy of housing 10 might be of concern. The reason for this is that the reduced wall thickness of the figure eight configuration of housing 10 serves to reduce the total dead weight of the structure whem compared with the dead weight of structures of rectangular configuration. Resistance to buoyancy can be achieved by extending base 48 laterally beyond the outer surfaces of sections 12 and 14 as shown in FIG. 1 so that the backfill above the extension 98 will provide suitable anchorage of housing 10 within the ground.

It appears that a potential saving in civil engineering design man-hours is possible using the figure eight concept due to the simplified structural features thereof. This fact is evident because the elaborate analyses and detailing required for designing slab and beam retaining walls is simplified with the figure eight configuration. Electrical, instrumentation and mechanical effort would not require an increase in man-hours over that required with the use of the rectangular configuration.

We claim:

1. Structure for containing an ore crusher and associated ore handling equipment below ground level comprising: a hollow, concrete housing having a pair of upright tubular segments and a common wall between the segments at the region of intersection thereof, the segments having convex outer surfaces and defining with the wall a generally figure eight configuration, the housing adapted to be disposed below ground level and having a floor disposed within and integral with one of the segments for supporting an ore crusher, said floor having an opening therethrough, the ore crusher being operable to discharge through said opening when the ore crusher is supported by said floor.

2. Structure as set forth in claim 1, wherein each segment is transversely circular throughout a major portion thereof.

3. Structure as set forth in claim 1, wherein at least one of the segments is transversely elliptical throughout a major portion thereof.

4. Structure as set forth in claim 1, wherein said supporting means comprises a corbel or floor integral with said one segment and extending inwardly therefrom, said corbel or floor adapted to be coupled in supporting relationship to the ore crusher.

5. Structure as set forth in claim 1, wherein the segments have cylindrical portions throughout substantially their entire length, the diameters of the cylindrical portion of said first segment being different from the diameter of the cylindrical portion of the second segment.

6. Structure as set forth in claim 1, wherein said wall is in a generally vertical plane.

7. Structure as set forth in claim 6, wherein said wall has a pair of opposed, generally flat faces and a pair of side margins, the sections being integral with said wall at said side margins.

8. Structure for mounting an ore crusher and associated ore handling equipment comprising: a housing of reinforced concrete adapted to be disposed below ground level and having a pair of interconnected, tubular segments defining in plan form a generally figure eight configuration therefor, each segment having a convex outer surface, one of the segments having first means for supporting an ore crusher, an opening for receiving feed ore, a space for receiving crushed ore from the crusher, and second means for mounting a feeder aligned with said space, the other segment having third means for supporting the crusher drive motor, fourth means for mounting an elevator therein and fifth means for mounting an inclined ore conveyor aligned with one end of the feeder.

9. Structure as set forth in claim 8, wherein said first and third means include corbels integral with said segments and supported directly thereby.

10. Structure as set forth in claim 8, wherein said fifth means includes an inclined tube integral with the other segment at the lower end thereof, the tube being in communication with the other segment to permit the ore conveyor to extend from said other segment into and through said tube.

11. Ore handling apparatus comprising: a housing of reinforced concrete and having a pair of generally hollow tubular segments and a wall interconnecting the intersecting ends of said segments, each segment having a convex outer surface, said segments and said wall being integral, and said segments and said wall defining in plan form a generally figure eight configuration for the housing, said housing adapted to be disposed in the ground with the upper ends of the segments being adjacent to ground level, one of the segments having an open, upper, ore-receiving end; an ore crusher; means mounting the ore crusher in said one segment below the upper end thereof; a first, generally horizontal feeder in said one segment below the ore crusher and extending into the other segment; an inclined conveyor in the other segment and extending outwardly therefrom, said conveyor having a lower end aligned with and disposed below the proximal end of the first feeder; elevator means in the second segment between the upper and lower ends thereof; and access hatches through the floors of the second segment for entry and removal of mechanical and electrical parts.

12. Apparatus as set forth in claim 11, wherein said crusher mounting means includes a corbel or floor integral with said one segment and extending inwardly from the inner surface thereof.

13. Apparatus as set forth in claim 11, wherein is included a drive motor having a drive shaft, means in said other segment for mounting the drive motor therein, said wall having an opening therein, said drive shaft extending through said opening and being coupled to said ore crusher for actuating the same.

14. Apparatus as set forth in claim 11, wherein each segment is tranversely circular throughout a major portion thereof.

15. Apparatus as set forth in claim 11, wherein at least one of the segments is transversely elliptical throughout a major portion thereof.

16. Apparatus as set forth in claim 8, wherein at least one of the segments is transversely circular throughout a major portion of the cross section thereof.

17. Apparatus as set forth in claim 8, wherein at least one of the segments is transversely elliptical throughout a major portion of the cross section thereof.

* * * * *